US011648797B2

(12) United States Patent
Wolf

(10) Patent No.: US 11,648,797 B2
(45) Date of Patent: May 16, 2023

(54) CARPENTER SPEED SQUARE WITH PENCIL SHARPENER

(71) Applicant: Barton Steven Wolf, Brookfield, WI (US)

(72) Inventor: Barton Steven Wolf, Brookfield, WI (US)

( * ) Notice: Subject to any disclaimer, the term of this patent is extended or adjusted under 35 U.S.C. 154(b) by 204 days.

(21) Appl. No.: 17/156,598

(22) Filed: Jan. 24, 2021

(65) Prior Publication Data

US 2022/0234380 A1 Jul. 28, 2022

(51) Int. Cl.
*B43L 7/027* (2006.01)
*B43L 23/08* (2006.01)

(52) U.S. Cl.
CPC ..... *B43L 7/0275* (2013.01); *B43L 23/08* (2013.01)

(58) Field of Classification Search
CPC ..... B43L 7/0275; B43L 23/08
See application file for complete search history.

(56) References Cited

U.S. PATENT DOCUMENTS 5,040,256 A * 8/1991 Mills ..... G01B 3/00 7/164
5,749,153 A * 5/1998 Viens ..... B43L 7/02 33/485
6,941,605 B2 * 9/2005 McCreesh ..... B43L 13/02 7/164
7,398,601 B2 * 7/2008 Morrell ..... B25H 7/00 33/429
7,487,596 B2 * 2/2009 Nash ..... G01C 15/12 33/290
2005/0283987 A1 * 12/2005 Nash ..... G01C 15/004 33/286
2007/0277387 A1 * 12/2007 Morrell ..... B43L 12/02 33/429
2022/0184998 A1 * 6/2022 Allemand ..... B43L 7/0275
2022/0234380 A1 * 7/2022 Wolf ..... B43L 7/0275

* cited by examiner

*Primary Examiner* — Yaritza Guadalupe-McCall

(57) ABSTRACT

The present invention relates to a device and a method associated with the device. The device is a carpenter speed square generally comprised of a flat triangular frame with one 90 degree angle and two 45 degree angles. The frame has a flange that protrudes outward from its top and bottom faces along one of the edges adjacent to the 90 degree angle. The device has an integrated means for sharpening pencils. With respect to the associated method, the user holds the device in their non-dominant hand with that hand wrapping around the flange with the right angle on the side adjacent to the thumb. Using their dominant hand and the integrated pencil sharpener the pencil is sharpened. Once sharpened, the pencil will be in the users dominate hand and the device will be in the uses non-dominate hand which is conducive to common layout and marking operations.

9 Claims, 9 Drawing Sheets

Section A-A

Section B-B

CARPENTER SPEED SQUARE WITH PENCIL SHARPENER

CROSS-REFERENCE TO RELATED APPLICATIONS

This application claims the benefit of the U.S. Provisional Application No. 62/965,830, filed on Jan. 25, 2020, which was filed by the present inventor and is incorporated by reference in its entirety, and U.S. Provisional Application No. 62/965,831, filed on Jan. 25, 2020, which was filed by the present inventor and is incorporated by reference in its entirety.

FIELD OF THE INVENTION

The present invention generally relates to layout and measuring tools. More specifically, it relates to a layout and measuring tools that provides the user an ability to measure and mark angles with an integrated ability to sharpen a pencil.

BACKGROUND

It is desirable to have a sharp pencil when doing layout work in carpentry. Typical tools used together in layout work include the pencil, speed square and tape measure. The pencil requires regular sharpening that is typically done using an additional tool such as a pencil sharpener or knife.

Currently there are a number of carpenter's speed square variations with functionality to measure and mark commonly needed layout lines. These solutions fail to meet the combined needs of measuring and marking layout lines and maintaining a sharp pencil for marking layout lines in a singular device.

SUMMARY OF THE INVENTION

To eliminate the need of this additional tool it is desirable to have pencil sharpening capability integrated into a layout tool. Furthermore, it would also be desirable to have ergonomic hand positions on the pencil and layout tool while sharpening the pencil. Still further, it would be desirable to have the pencil sharpening capability integrated into the layout tool such that when sharpening is complete the pencil and layout tool are being held in a way that they are ready for their next use or function without the need to reposition or re-grip.

The disclosed device and associated method advantageously fill these needs and addresses the aforementioned deficiencies by providing a speed square that has the integrated ability to sharpen a pencil while the speed square is being gripped in a similar fashion to how it would be gripped while marking a layout or cut line.

Other aspects of the present invention shall be more readily understood when considered in conjunction with the accompanying drawings, and the following detailed description, neither of which should be considered limiting.

DETAILED DESCRIPTION

The present invention is directed to a carpenter's speed square 100 with means for sharpening a round pencil 10 or a carpenter's pencil 20. The inventive concept is presented herein across multiple embodiments.

Figure 1A:
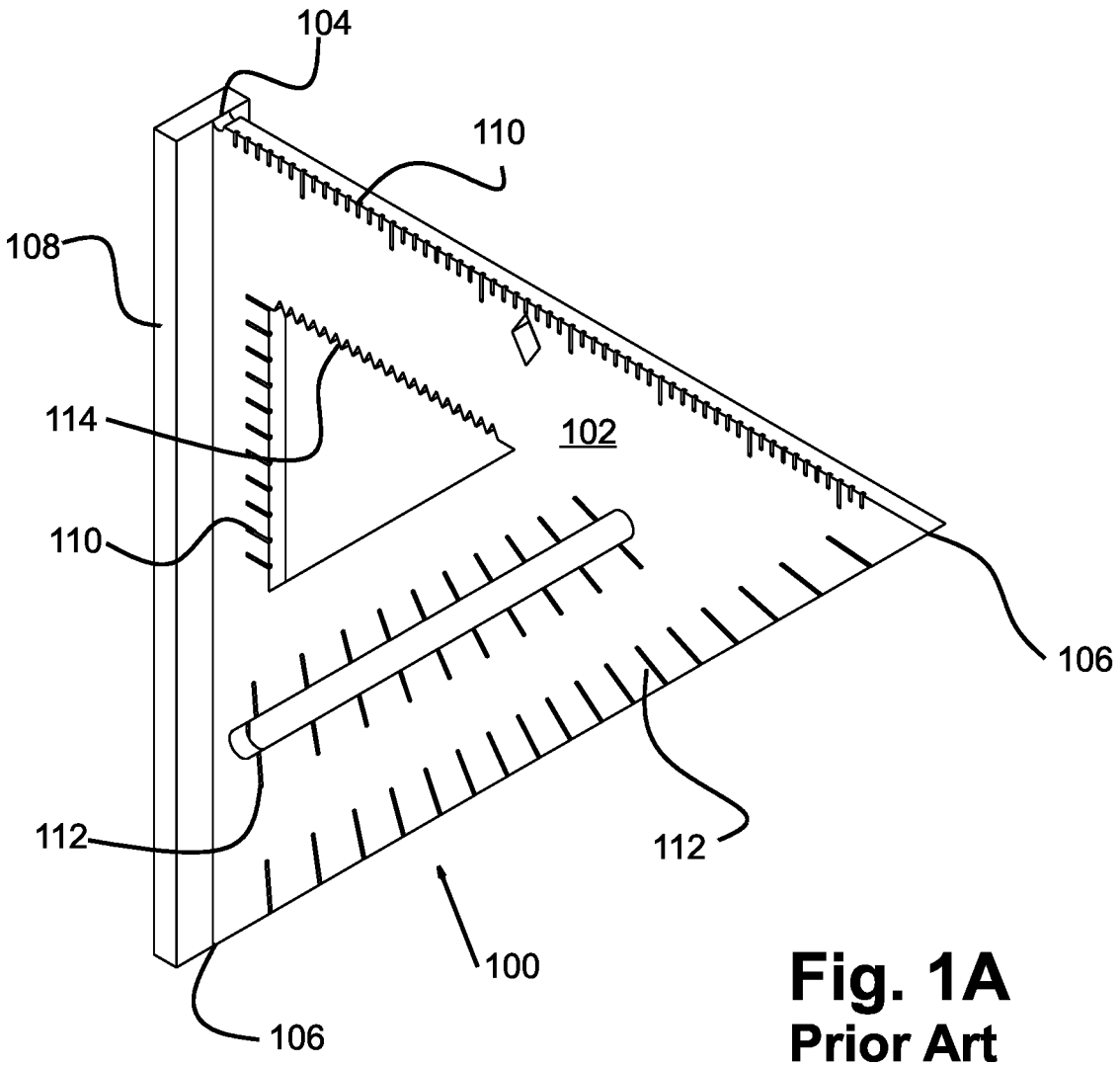
Fig. 1A Prior Art
FIG. 1A shows various aspects that are common to prior art.

Referring now to FIG. 1A, which depicts the prior art for what is generally considered a carpenter's speed square 100. The basic structure contains a triangular frame 102 possessing one 90 degree angle 104, two 45 degree angles 106, and a flange 108 along one of the sides adjacent to the 90 degree angle 104. The structure containing the frame 102 and flange 108 may be constructed of polymer or metal alloy and is generally formed using common injection molding or die-casting processes. There are many variations of the carpenter's speed square; however, the carpenter's speed square is generally defined by these aspects.

To illustrate one possible variation of the carpenter's speed square, FIG. 1A shows graduated markings 110 for measuring distance, graduated markings 112 for measuring angels or slopes and notches 114 for guiding a pencil during marking operations. The carpenter's speed square 100 is not defined by the presence of these markings or notches or the absence of different markings or notches. Additionally, it's understood that other variations of the carpenter's speed square 100 have additional feature such as scales or markings used for common carpentry layout work, adjustable attachments to mark or measure angles, water or spirit levels, or notches for holding or aligning a pencil lead during a marking operation and still be considered a carpenter's speed square as defined above. Furthermore, it is understood that the utility of the carpenter's speed square may extent functions other than marking and measuring such as guiding saws or cutting tools.

Figure 1B:
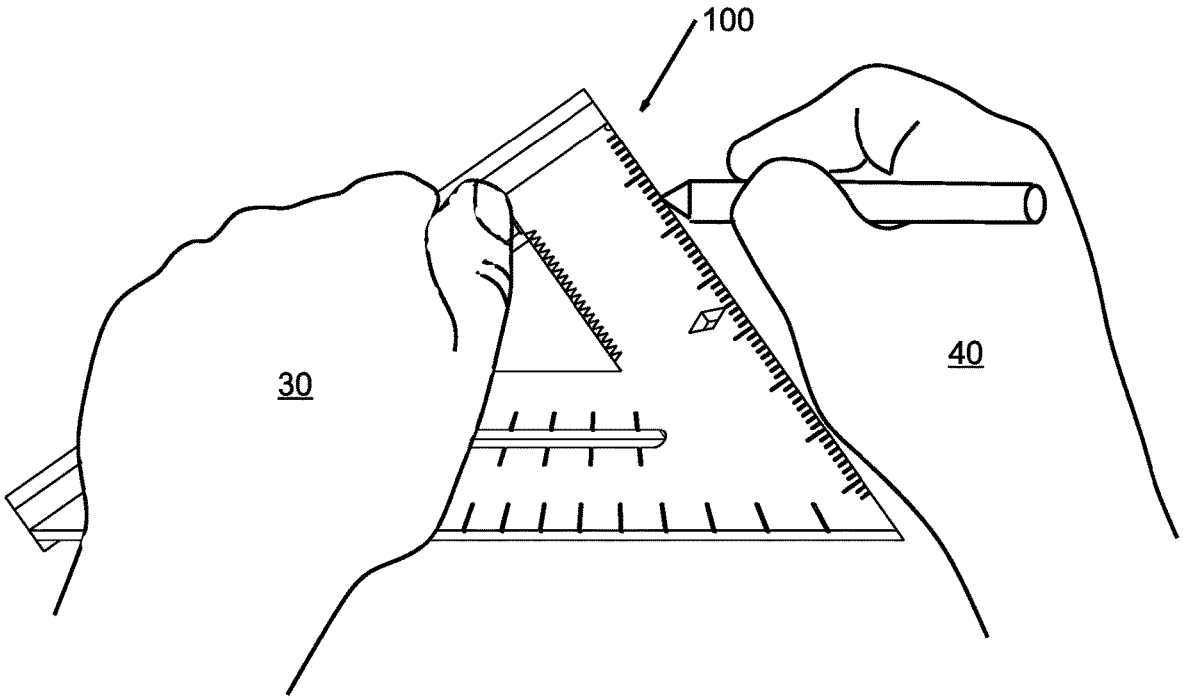
Fig. 1B Prior Art
FIG. 1B shows how the prior art is held during common operations.

Referring to FIG. 1B, during a marking operation the carpenter's speed square is held in the user's non-dominant hand 30 while the marking device is griped with the user's dominant hand. The user's grip is often overhand and wrapped over the flange 108. While the figures show the non-dominate hand to be the users left hand (a right handed user's non-dominate hand) it is understood that a user could reorient the carpenter's speed square 100 to produce a grip similar to what is shown accept with the user's right hand (a left handed user's non-dominant hand).

The invention described herein builds upon the prior art by incorporating the ability to sharpen a pencil while holding the carpenter's speed square 100 in the user's non-dominant similar to how it would be commonly held while marking a line and while maintaining a natural (ergonomic) wrist position.

Figure 2A:
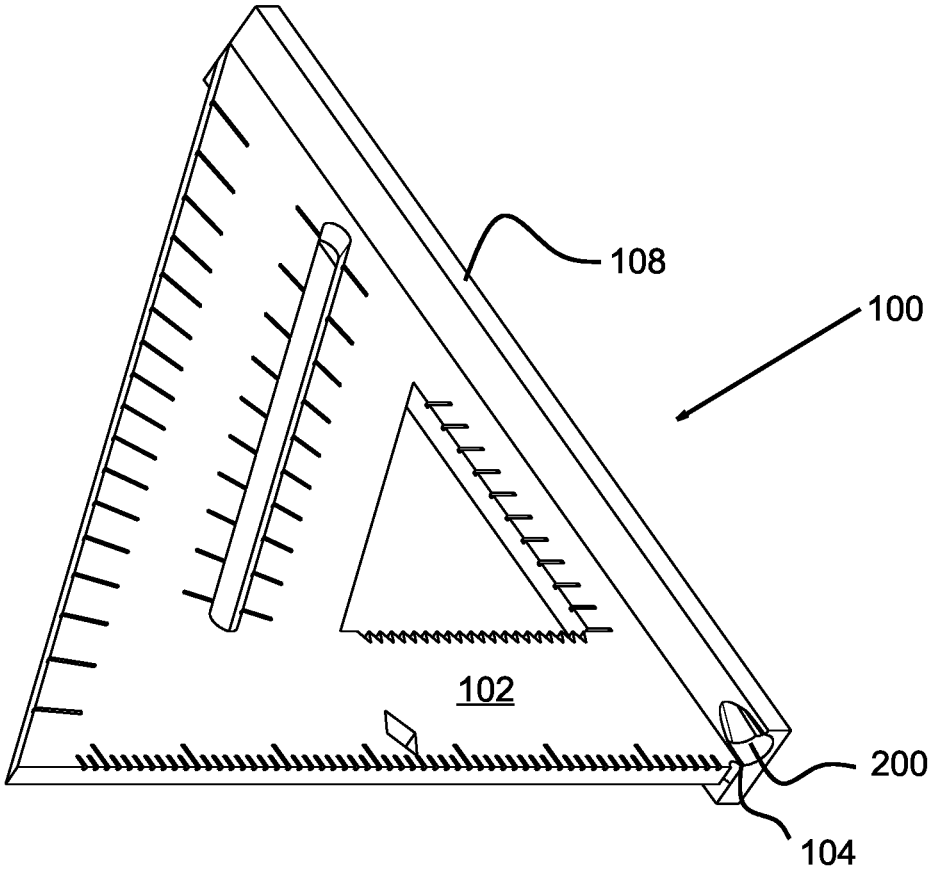
FIGS. 2A, 2B, 2C and 2D show various aspects of one embodiment.
Figure 2B:
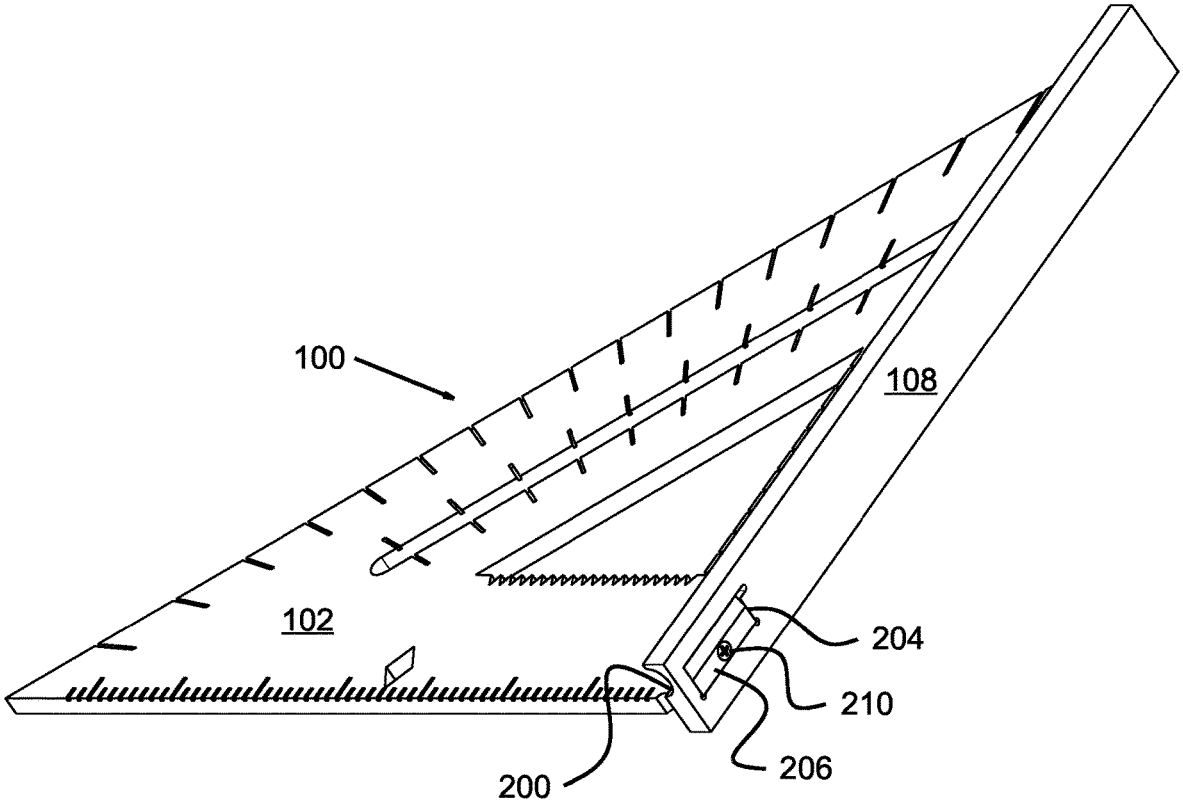
Figure 2C:
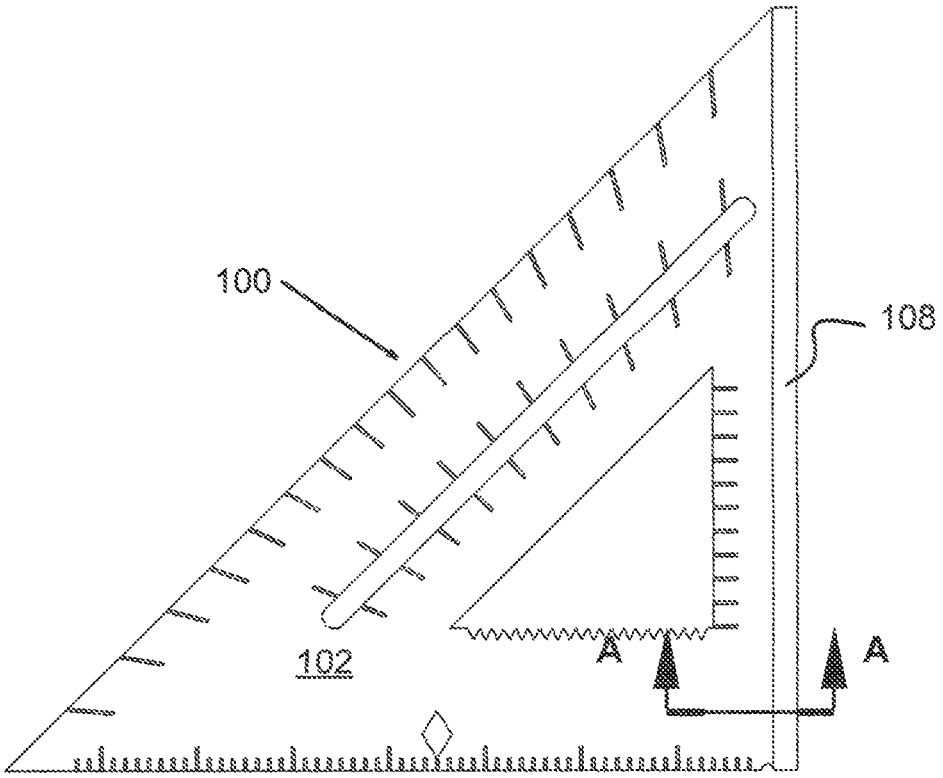
Figure 2D:
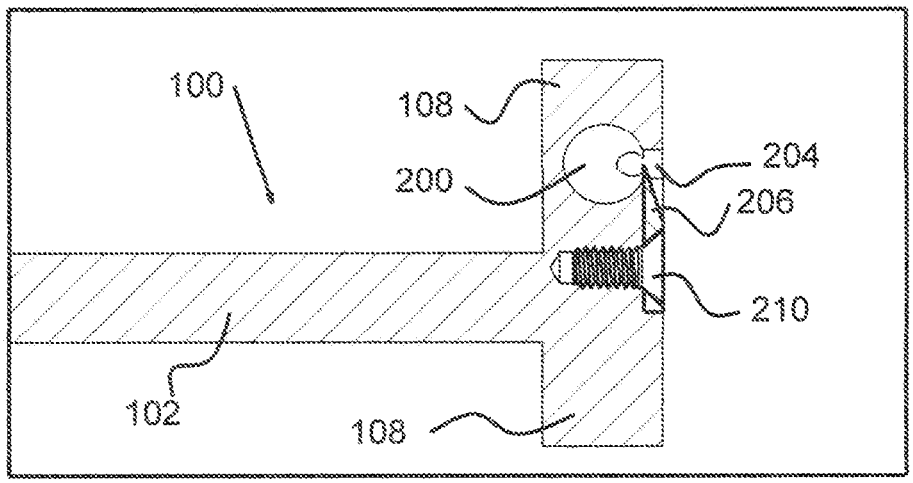

FIG. 2A through FIG. 2E show the construction and operation of an exemplary embodiment of the invention with means to sharpen the round pencil 10. Referring now to FIG. 2A through FIG. 2D, this embodiment contains a conically shaped cavity 200 in the flange 108 near the 90 degree angle 104. The conically shaped cavity 200 is a hollow negative of a sharpened round pencil 10 tip. The conically shaped cavity 200 is oriented such that the round pencil is inserted in the side of the flange 108 that is adjacent to the frame 102 near the 90 degree angle 104. Furthermore, the conically shaped cavity 200 is oriented such that the edge of the conical tip of a sharpened round pencil 10 is roughly parallel to the flange 108. The conically shaped cavity 200 extends into the recess for the blade 204 located on the outside of the flange 108. The conically shaped cavity 200 and recess 204 are generally formed during the injection molding or die-casting process that creates the structure containing the frame 102 and flange 108. Alternatively, the conically shaped cavity 200 and recess 204 could be added by removing material form the flange 108 after frame 102 and flange 108 have been constructed. There is blade 206 set in the recess 204 such that the blade 204 is slightly protruding into the conically shaped cavity 200 as seen in FIG. 2D. The blade 206 is generally constructed of a metal alloy that is capable of forming and maintaining a sharp edge. The blade is secured to the flange 108 with one or more fasteners 210. The fastener 210 may be a screw, rivet or other structure that is independent of the flange 108 or formed as part of the flange 108.

Figure 2E:
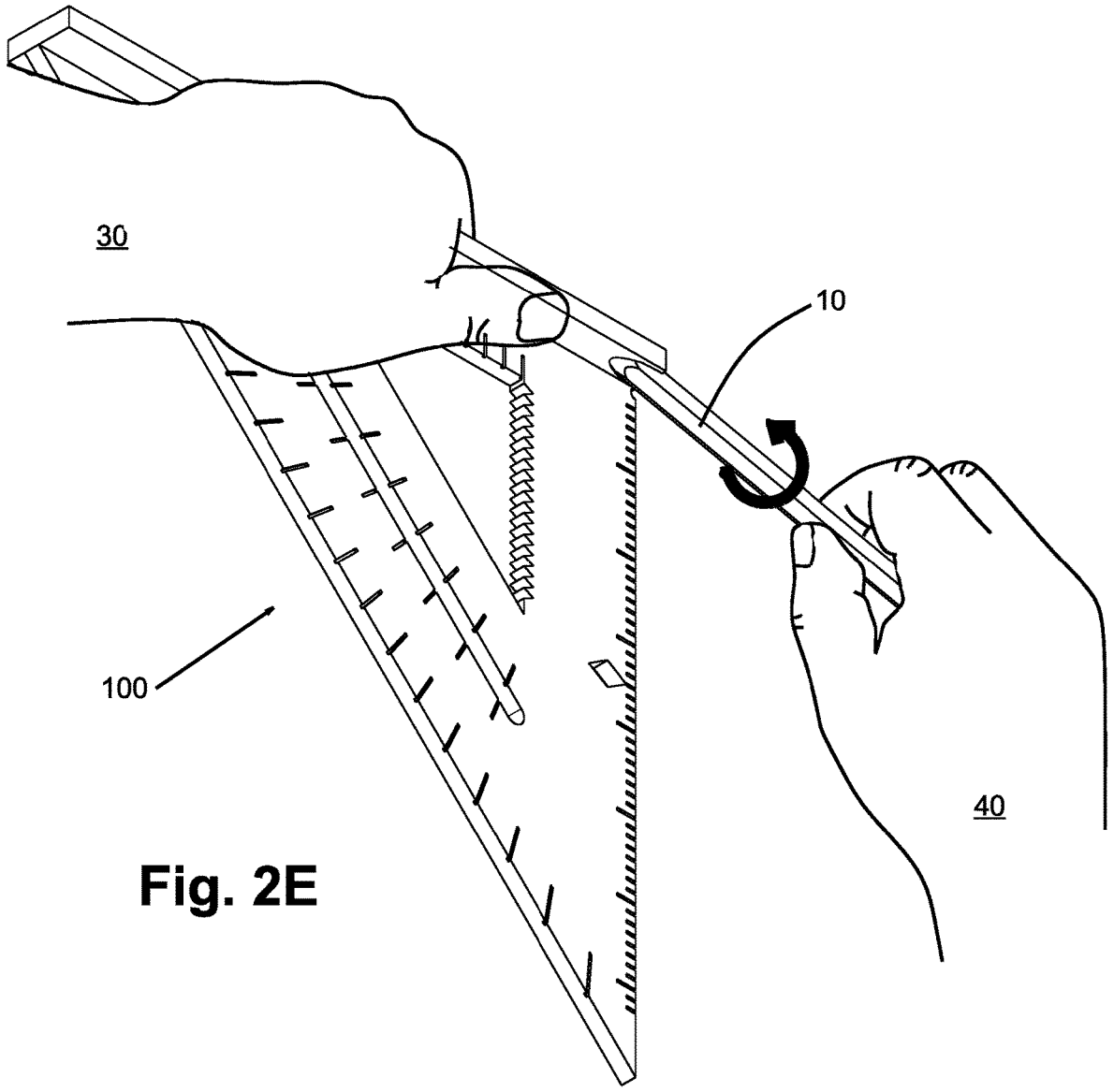
FIG. 2E shows the operation of one embodiment.

Referring now to FIG. 2E, in operation, the user's non-dominate hand 30 is wrapped around the flange 108 and grips the frame 102. While holding the frame 102, the round pencil 10 is inserted into the conically shaped cavity 200 with the user's dominate hand 40. The resulting orientation of the user's hands allows the wrists to remain in a neutral position. As the round pencil 10 enters the conically shaped cavity 200, it comes into contact with the blade 206. The round pencil 10 is rotated against the blade 206 removing material from the round pencil 10 which causes a point to form on the inserted end of pencil 10. Once a sharp point is formed on the end of the round pencil 10, it is removed from the cavity 200. Upon completion of aforementioned process, the user is holding the carpenter's speed square 100 in a common orientation for marking a work piece using their non-dominate hand 30. Furthermore, the user is holding the round pencil 10 in their dominate hand 40.

Figure 3A:
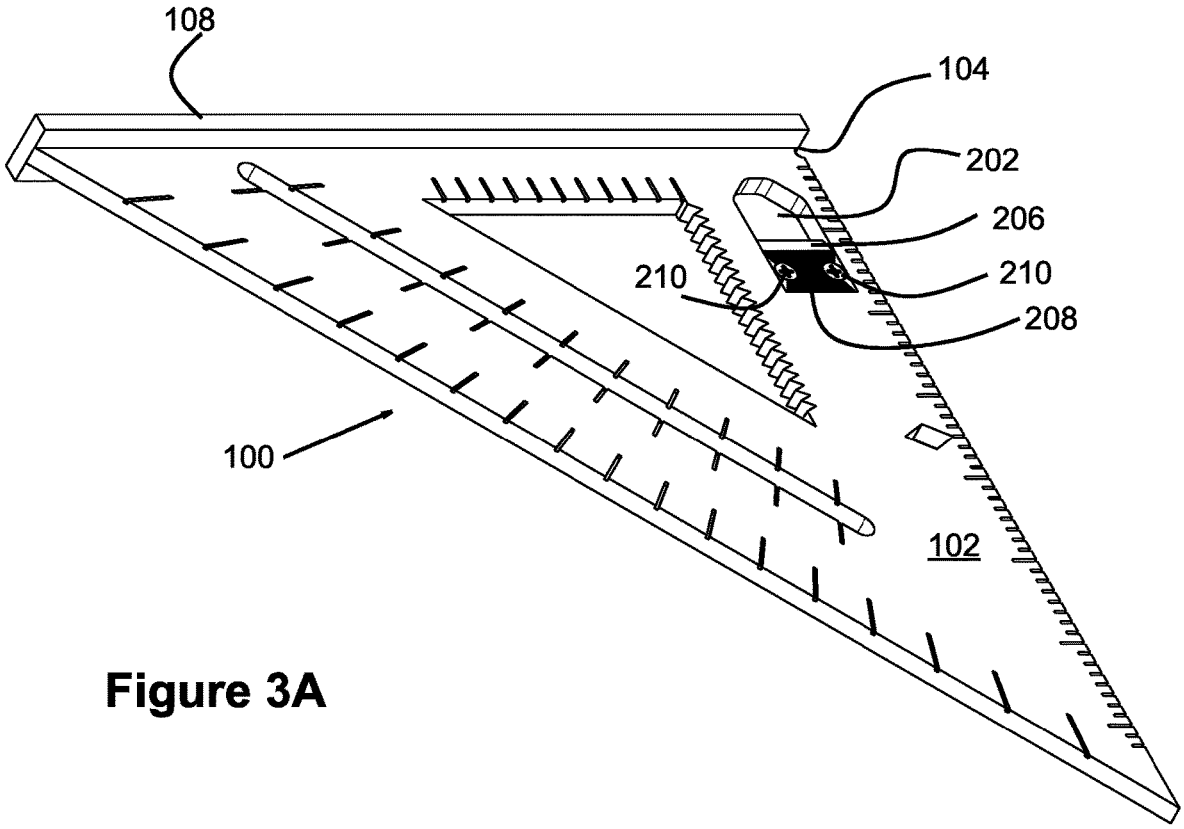
FIGS. 3A, 3B and 3C show various aspects of an alternative embodiment.
Figure 3B:
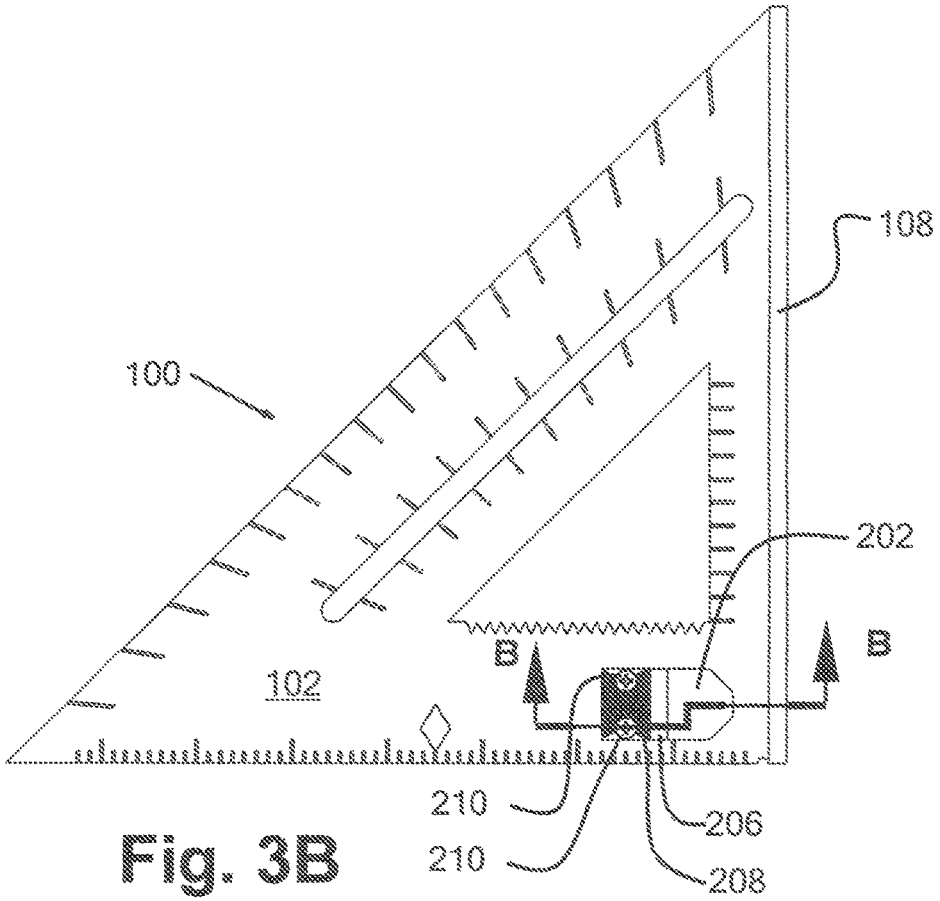
Figure 3C:
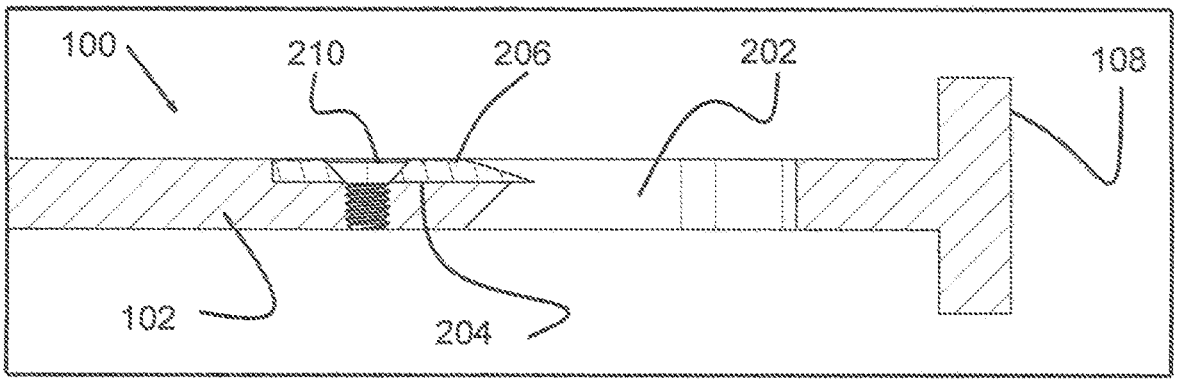

FIG. 3A through FIG. 3D show the construction and operation of an alternative embodiment of the invention that has the means to sharpen both the round pencil 10 and carpenter's pencil 20. Referring now to FIG. 3A through FIG. 3C, this embodiment contains an aperture 202 in the frame 102 near the 90 degree angle 104. There is a recess 204 in the top surface of the frame adjacent to the aperture 202 on the side of the aperture 202 opposite flange 108. The aperture 202 and recess 204 are generally formed during the injection molding or die-casting process that creates the structure containing the frame 102 and flange 108. Alternatively, the aperture 202 and recess 204 could be added by removing material form the frame 102 after frame 102 and flange 108 have been constructed. There is blade 206 set in the recess 204 such that the blade 204 is slightly protruding into the aperture 202 as seen in FIG. 3C. The blade 206 is generally constructed of a metal alloy that is capable of forming and maintaining a sharp edge. The outer surface of the blade 208 which is adjacent to the top surface of the frame 102 has an abrasive texture 208. The abrasive texture 208 may be formed into the blade material, applied to the surface of the blade material or be inherent to the material chosen for the blade 208. The blade 208 is secured to the frame 102 with one or more fasteners 210. The fastener 210 may be a screw, rivet or other structure that is independent of the frame 102 or formed as part of the frame 102.

Figure 3D:
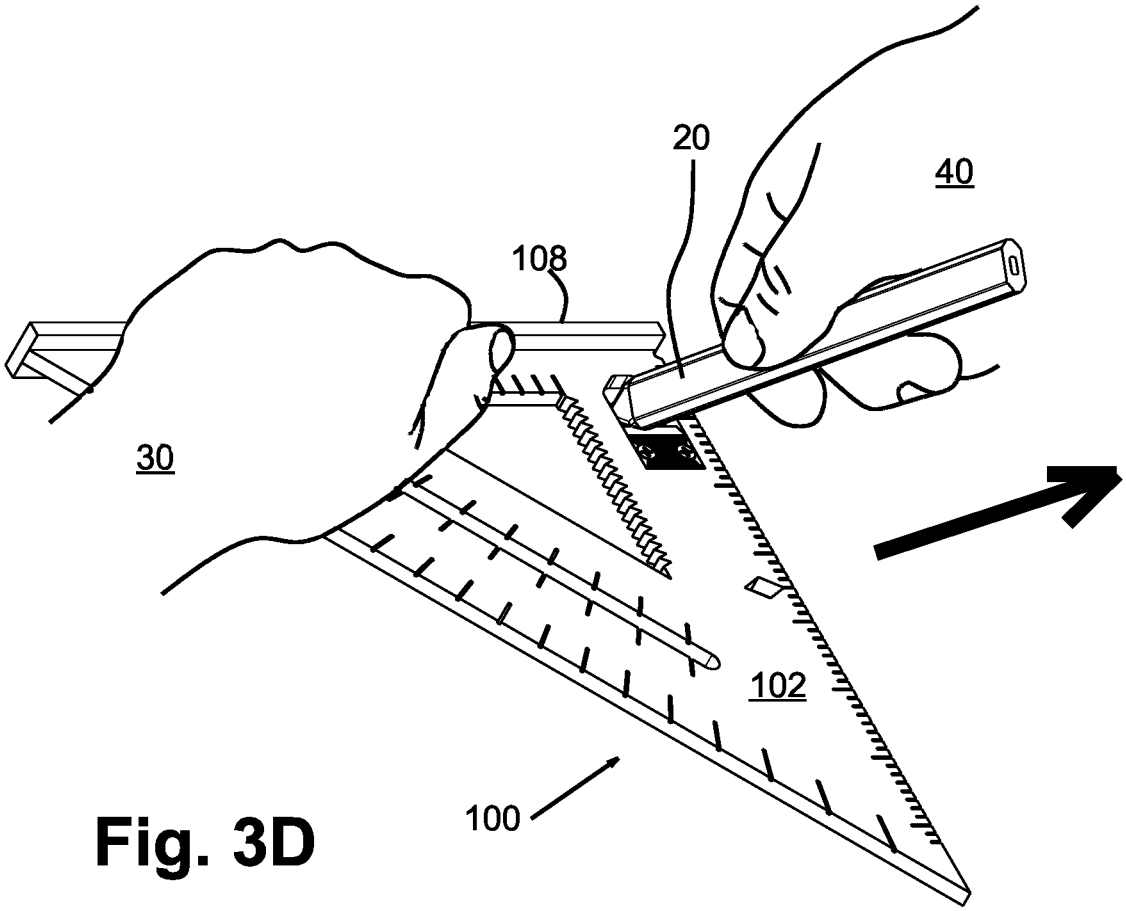
FIG. 3D shows the operation of an alternative embodiment.

Referring now to FIG. 3D, during operation the user's non-dominate hand 30 is wrapped around the flange 108 and grips the frame 102. While holding the frame 102, the carpenter pencil 20 is inserted through the aperture 202 then pulled back across the blade 206 with the user's dominate hand 40. The process of pulling the carpenter pencil 20 across the blade 206 removes material from the carpenter pencil 20 exposing lead and creating a sharpened point on the end of the carpenter pencil 20. The point of the carpenter pencil 20 can be refined by rubbing it across the abrasive texture 208. It is recognized that while the aforementioned process referenced a carpenter pencil 10, this embodiment and the aforementioned process may substitute the carpenter pencil 20 for a round pencil 10. Furthermore, upon completion of aforementioned process, the user is holding the carpenter's speed square 100 in a common orientation for marking a work piece using their non-dominate hand 30. Furthermore, the user is holding the carpenter pencil 20 or round pencil 10 in their dominate hand 40.

Different features, variations and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by both this disclosure. It is indeed intended that the scope of this disclosure should be determined by a proper legal interpretation and construction of the disclosure, including equivalents, as understood by those of skill in the art relying upon the complete disclosure present at the time of filing.

What is claimed is:

1. A device for measuring angles and distance; and guiding a marking instrument or cutting tool at a defined angle or distance of known type that contains a means to improve the function of a marking instrument such as a pencil comprising:

a frame that is generally triangular in shape
- wherein the frame is flat and,
- wherein the frame contains one 90 degree angle as viewed from the top or bottom surface, a flange that protrudes outward from the top and bottom faces for the frame
- wherein the flange is adjacent and parallel to one edge of the frame and,
- wherein the flange is adjacent to the 90 degree angle of the frame, and, a means to remove material from the marking end of a marking instrument such that the marking end of the instrument is transformed to sharp point and the internal material of the marking instrument is exposed at the marking end
- wherein the means to remove material from a marking instrument is comprised of a conically shaped cavity that is formed into the device and is an approximate negative of the desired shape of the marking end of marking instrument and,
- wherein a blade that is affixed to the device such that it is parallel to the inner surface of the conically shaped cavity and its sharpened edge protrudes into the conically shaped cavity such that, the marking end of a marking instrument may be inserted into the conically shaped cavity such that it makes contact with the sharpened edge of the blade and rotation of the marking instrument will cause material to be removed from its marking end and wherein the inner surface of the conically shaped cavity and the blade are parallel to the face of flange opposite the frame and wherein when the marking instrument is inserted into the cavity it forms an angle less than 180 degrees to the inner surface of the flange.

2. The device for measuring angles and distance; and guiding a marking instrument or cutting tool at a defined angle or distance of claim 1 wherein while the user is removing material from a marking instrument the user is able to hold the devise in a fashion that is common to how the devise could be held for measuring angles and distance; and guiding a marking instrument at a defined angle.

3. The device for measuring angles and distance; and guiding a marking instrument or cutting tool at a defined angle or distance of claim 2 wherein the user could transition between removing material from a marking instrument and measuring angles and distance; and guiding a marking instrument at a defined angle without adjusting how the device is held.

4. The device for measuring angles and distance; and guiding a marking instrument or cutting tool at a defined angle or distance of claim 1 wherein the means to remove material form the marking end of a marking instrument is located in the flange such that:

the opening of the conically shaped cavity is in the face of the flange adjacent to the 90 degree angle extending into the face of the flange that is adjacent to the frame and the blade is located in the face of the flange opposite the frame.

5. The device for measuring angles and distance; and guiding a marking instrument or cutting tool at a defined angle or distance of claim 1 wherein the action of removing of material from the marking end of the marking instrument allows the user's wrists to maintain a neutral or ergonomic orientation.

6. The device for measuring angles and distance; and guiding a marking instrument or cutting tool at a defined angle or distance of claim 1 wherein the means to remove material from a marking instrument is comprised of:

an aperture in the frame a blade located in the face of the frame such that sharpened edge of the blade protrudes into the aperture allowing the user to insert a marking instrument through the aperture and then pull the marking instrument back through the aperture while contacting the sharpened edge of the blade and removing material from the marking end of the marking instrument.

7. The device for measuring angles and distance; and guiding a marking instrument or cutting tool at a defined angle or distance of claim 6 wherein the outward face of the blade has an abrasive texture that may be used to further refine the marking end of a marking instrument.

8. The device for measuring angles and distance; and guiding a marking instrument or cutting tool at a defined angle or distance of claim 6 wherein aperture is located near the 90 degree angle and the sharpened edge of the blade is oriented parallel to the flange.

9. The device for measuring angles and distance; and guiding a marking instrument or cutting tool at a defined angle or distance of claim 8 wherein the action of removing of material from the marking end of the marking instrument allows the user's wrists to maintain a neutral or ergonomic orientation.

* * * * *